US006192606B1

(12) United States Patent
Pavone

(10) Patent No.: US 6,192,606 B1
(45) Date of Patent: Feb. 27, 2001

(54) HELIUM FILLED SOLE

(76) Inventor: Luigi Alessio Pavone, P.O. Box 630556, Houston, TX (US) 77263-0056

( * ) Notice: Subject to any disclaimer, the term of this patent is extended or adjusted under 35 U.S.C. 154(b) by 0 days.

(21) Appl. No.: 09/534,687

(22) Filed: Mar. 24, 2000

(51) Int. Cl.[7] ..... A43B 13/20
(52) U.S. Cl. ..... 36/29; 36/35 B; 36/28
(58) Field of Search ..... 36/28, 29, 71, 36/30 R, 35 B

(56) References Cited

U.S. PATENT DOCUMENTS 4,887,367 * 12/1989 Mackness et al. ..... 36/29
4,999,931 * 3/1991 Vermeulen ..... 36/29
5,042,176 * 8/1991 Rudy ..... 36/29
5,894,687 * 4/1999 Lin ..... 36/29
6,009,637 * 1/2000 Pavone ..... 36/29

* cited by examiner

*Primary Examiner*—M. D. Patterson
(74) *Attorney, Agent, or Firm*—Valerie K. Friedrich

(57) ABSTRACT

An improved sole for use with all types of footwear, including dress, casual, and athletic shoes and sandals, which has an upper layer having a plurality of chambers filled with helium. The upper layer is attached to an outsole having indentations, corresponding to the chambers, and coated with a fluidic polymeric material.

1 Claim, 2 Drawing Sheets

HELIUM FILLED SOLE

FIELD OF THE INVENTION

The present invention relates generally to all types of footwear, including casual shoes, dress shoes, athletic shoes and sandals, and specifically to an improved sole and footwear incorporating such soles.

BACKGROUND OF THE INVENTION

The advantages of a gas filled sole are well known and are discussed in some detail in a number of patents, such as the discussions in U.S. Pat. Nos. 4,887,367 and 4,936,029. Soles filled with gasses provide shock absorption and resiliency superior to that achievable with material soles. The choice of gas or gas mixtures used in soles affects not only the final weight of the footwear but also the degree of resiliency and elasticity and the useful life of the sole. Because of its light weight, helium is an optimum choice of gas for use in soles, particularly for use in athletic shoes in which any decrease in shoe weight may aid in running and jumping.

Recent attempts to use helium in soles of athletic shoes, however, have been unsuccessful as helium is the second lightest gas and is comprised of small atoms which easily diffuse through the materials used to construct the soles and helium bladders therein. The result of these prior efforts is a deflated shoe sole which does not provide the lift and support obtained from a filled helium sole. Other athletic shoe manufacturers have used heavier gasses to inflate shoe soles. Such soles, however, are heavier than those of the present invention and do not provide the degree of lift and elasticity obtainable with the soles of the present invention.

Despite the need for resilient and lightweight footwear, the sole of the shoe or sandal must also provide sufficient support to the foot and must be sufficiently durable to provide an acceptable service life. Furthermore, it is advantageous for the amount of support and resilience provided by the sole to different areas of the foot to vary as the stride of the wearer progresses. That is, in walking, jogging or running, the area of the foot in contact with the ground rotates from the heel to the ball of the foot. Therefore, it is well known to permit the gas to flow into and out of connecting chambers underlying the ball and the heel of the foot. Because of the light weight of helium, as the gas moves between the chambers, the sole imparts a lift to the foot and facilitates the natural roll of the stride.

The present invention is an improvement to the invention disclosed and claimed in U.S. Pat. No. 6,009,637, issued on Jan. 4, 2000 and entitled "Helium Footwear Sole." The '637 patent describes a sole comprised of a silicone midsole having core modules filled with helium. One of the difficulties associated with the type of helium filled soles described in the '637 patent is the propensity of the helium to diffuse through the materials of the midsole and escaping into or through the top sole or bottom sole. The present invention addresses this problem and provides a sole which impedes such diffusion of the helium resulting in a sole which contains the helium for the useful life of the footwear.

Great amounts of pressure can be generated on the foot during any kind of ambulation, including walking, jogging and running. Footwear manufacturers and designers attempt to ameliorate the discomfort of the foot pressing against a hard sole by using softer materials to construct either the sole or as a padding on top of the soles of footwear. Soles comprised of a soft material are generally not as durable as soles made of rigid or semi-rigid materials. Insole padding materials have a tendency to flatten and compress with use thereby decreasing the cushioning provided to the foot. Yet other manufacturers offer gel-filled insoles which can be purchased separately from the footwear and moved from shoe to shoe. Such movable insoles, however, take up space inside the shoe and can result in discomfort on the top of the foot. There is a need, therefore, for a sole which cushions the foot during the standard service life of footwear but yet which provides support and durability.

SUMMARY OF THE INVENTION

It is an object of the present invention to provide a helium filled sole which effectively contains the helium for an acceptable service life of the footwear.

It is a further object of the present invention to provide a sole with a bottom sole of superior cushioning properties.

The present invention provides a sole which maintains helium pressure during the standard service life of the footwear and which fluidly conforms to the shape of the foot during the stride. More specifically, the sole of the present invention is comprised of three sections: (1) an upper section molded into approximately the shape of the shoe or sandal, made of a plurality of layers of synthetic and metallic materials, and having a plurality of chambers molded into and protruding downward from the surface of the upper section; (2) an outsole having substantially the same shape as the upper section, made of a synthetic material, such as polyisoprene and having molded indentations of substantially the same shape as the chambers of the upper section and of a slightly larger size than such chambers; and (3) a layer of a fluidic polymeric material between said upper section and said outsole.

DETAILED DESCRIPTION OF THE INVENTION

Figure 1:
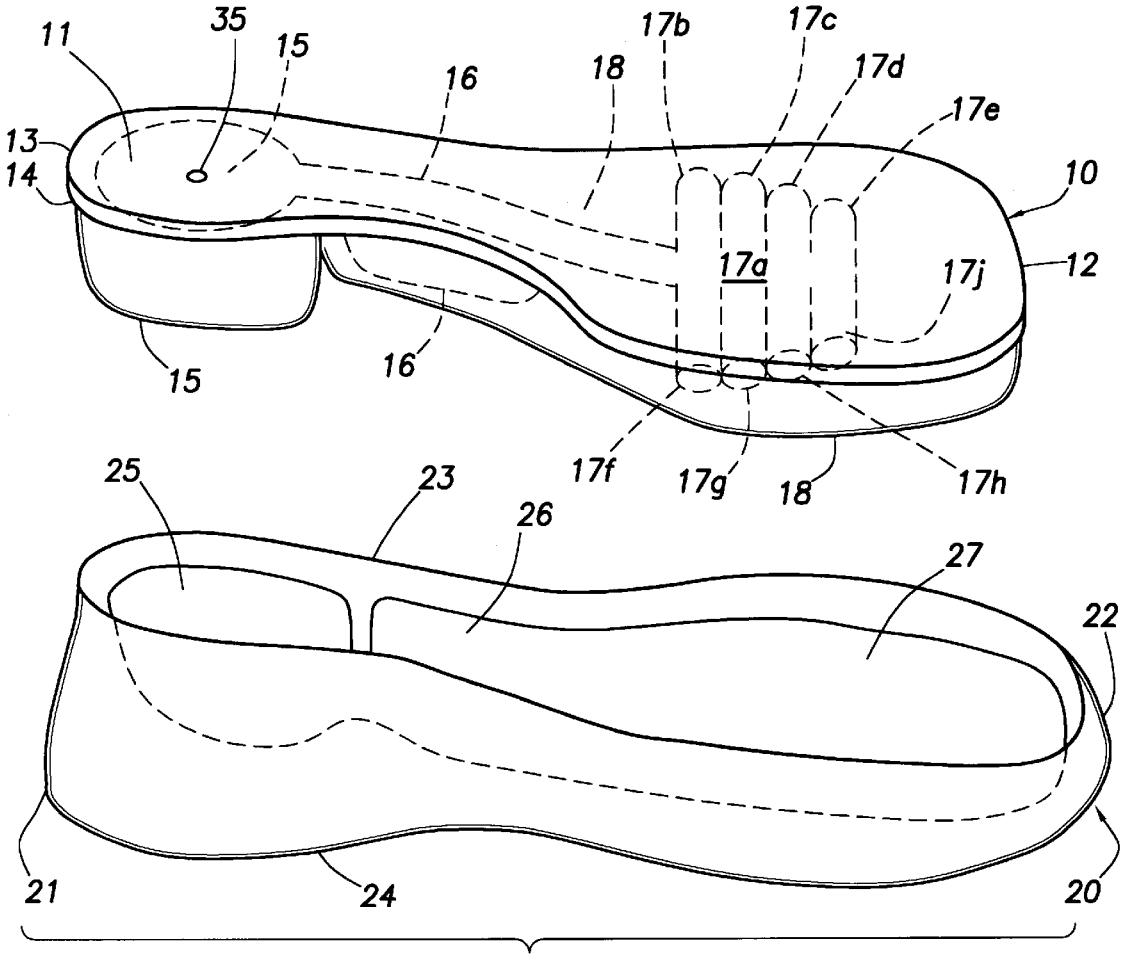
FIG. 1 is an exploded side perspective view of the upper section and outsole of the sole of the present invention.

Referring first to FIG. 1, the sole of the present invention is constructed of an upper layer 10 molded into substantially the shape as shown. The upper section is comprised of a top surface 11 having a toe end 12 and a heel end 13. Top surface 11 is usually substantially flat. However, it will be understood that top surface 11 may have an upward slope along the perimeter and may have a slope between toe end 12 and heel end 13 to accommodate a raised heel on the outsole 20. Protruding from the bottom surface 14 of upper layer 10 are a plurality of chambers which contain helium gas. In the preferred embodiment, upper layer 10 has a heel chamber 15, instep chamber 16, ball chambers 17, and return chamber 18.

Figure 2:
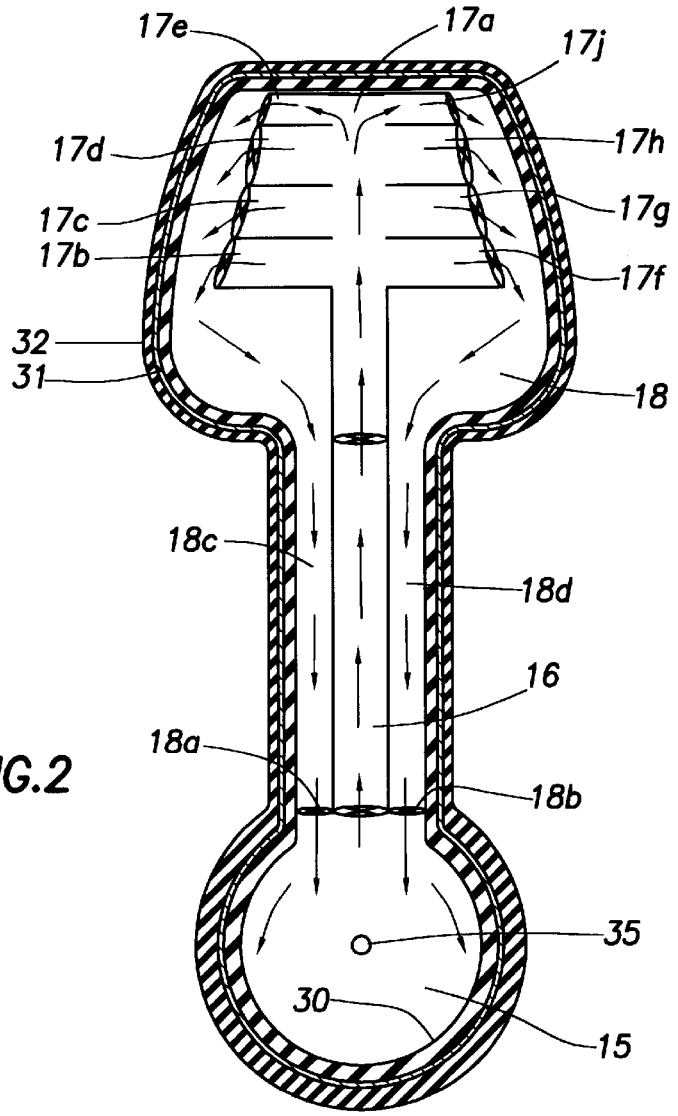
FIG. 2 is a top view of the midsole of the present invention illustrating the flow of the helium between the chambers.

Referring now to FIG. 2, heel chamber 15 is connected to the rear portion of central instep chamber 16. Central instep chamber 16 is substantially tubular in shape and extends lengthwise along the instep portion of the sole. Central instep chamber 16 is connected to heel chamber 15 by way of a one-way valve which permits helium to flow in only one direction, from the heel chamber 15 into central instep chamber 16. The forward portion of central instep chamber 16 is connected to the midsection, 17*a,* of ball chambers 17. Ball chambers 17 are comprised of a plurality of tubes, 17*b* through 17*j,* extending crosswise from and connecting with a central lengthwise tube 17*a*. Each of tubes 17*b* through 17*j* connects to tube 17*a*. Central instep chamber 16 is connected to central lengthwise tube 17*a* by way of a one-way valve which permits helium to flow only from the central instep chamber 16 into central lengthwise tube 17*a*. The arrows in FIG. 2 illustrate the flow of helium through the chambers of upper layer 10. Tubes 17*b* through 17*j* connect to return chamber 18 by way of one-way valves which permit the helium to flow from tubes 17*b* through 17*j* into return chamber 18. Return chamber 18 accepts helium flowing from tubes 17*b* through 17*j* and channels the helium along the outside portions of the instep section of the sole. Return chamber 18 connects to heel chamber 15 by way of two one-way valves 18*a* and 18*b* which permit the helium to flow only from return chamber 18 into heel chamber 15. Each of chambers 15, 16, 17*a*–17*j,* and 18 protrude downward from about 4 to 7 millimeters from the bottom surface of upper layer 10. The remaining dimensions of the chambers vary and are determined by the size of the footwear. Chambers 15 through 18 are filled by way of valve 35 (also shown in FIG. 1). It will be understood that valve 35 may be any of a variety of currently available valves, such as self-sealing diaphragms.

As the heel strikes the ground, the helium in heel chamber 15 will be pushed forward out of heel chamber 15 through instep chamber 16. As the foot rotates through the stride, the helium is pushed into central tube 17*a* and from there into tubes 17*b* through 17*j*. As the stride rotates to place pressure onto the ball of the foot, the helium is forced into return chamber 18 and back into heel chamber 15. It will be understood that the heel pressure is greater than that exerted by the ball of the foot. Therefore, in the preferred embodiment of the sole of the present invention, instep chamber 16 is larger in diameter than the side portions, 18*c* and 18*d,* of return chamber 18. Because helium is very light, the helium will flow more rapidly between the chambers than would air or heavier gasses, as are commonly used in athletic footwear. This rapid flow of helium will assist in the natural rotation of the foot stride thereby imparting additional lift and power to the wearer.

Referring again to FIG. 1, the sole of the present invention is further comprised of an outsole 20 having a heel portion 21, a toe portion 22, a top surface 23 and a bottom surface 24. Outsole 20 is molded from an appropriate synthetic material and in the preferred embodiment is made of polyisoprene. Molded into the top surface 23 of outsole 20 are a plurality of indentations in substantially the shape of chambers 15, 16, 17*a*–17*j,* and 18 of upper layer 10. As shown in FIG. 1, indentation 25 corresponds to chamber 15, indentation 26 to chambers 16 and portions of chamber 18, and indentation 27 to portions of chamber 18 and chambers 17*a*–17*j*. Each of chambers 25 through 27 are approximately 6 to 9 millimeters larger in height and 3 to 6 millimeters larger in width than the corresponding chambers. The sole of the present invention is assembled by adhering or affixing upper layer 10 to outsole 20. Consequently, there is a space between the lower surfaces of the chambers of upper layer 10 and the upper surfaces of the indentations of outsole 20. In the preferred embodiment of the sole of the present invention, such space is filled with a fluidic polymeric compound. The fluidic polymeric compound is injected by way of valve 36. It will be understood that valve 36 may be any of a variety of currently available valves, such as self-sealing diaphragms. It will be understood, however, that such space may alternatively be filled with air or other suitable gas.

The fluidic polymeric compound is composed of a mixture of a short-chain glycol, such as ethylene or propylene glycol, a short-chain alkoxylated alcohol, such as butoxy ethanol, and a desiccant, preferably in the form of a silicate salt, such as sodium silicate. Additional elements of the fluidic polymeric compound may include surfactants and/or fibrous plugging and matting agents. Any of a number of currently available surfactants, soluble in the glycol/alcohol/silicate mixture could be used, such as sodium lauryl sulfate. Fibrous plugging and matting agents are currently available, including for example, fibrous cellulosic materials. The layer of fluidic polymeric material provides an improvement in the ability of the sole to conform to the shape of the foot during a stride thereby increasing comfort while providing support. The fluidic polymeric material further strengthens the chambers 15 through 18 by providing a counter-pressure to that imposed by the foot. The combination of resiliency and conformability provided by the fluidic polymeric material prevents the helium filled chambers from bursting while yet remaining comfortable for the wearer.

Figure 3:
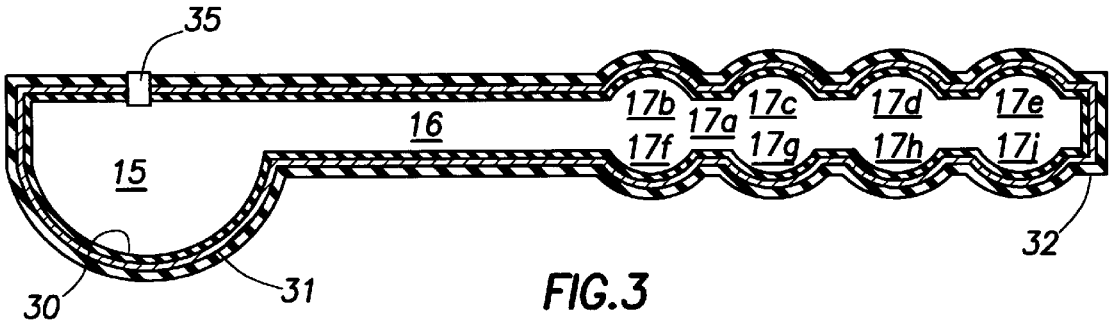
FIG. 3 is a cross-sectional view of the upper layer of the sole of the present invention taken along the lengthwise axis of the sole.

Referring now to FIGS. 2 and 3, the upper layer and the walls of each of chambers 15, 16, 17*a*–17*j* and 18 are comprised of three layers of material: (1) an inner layer of Mylar, 30, of approximately one-half millimeter thickness, which is surrounded by a layer of; (2) aluminum foil, 31, of approximately one-fourth millimeter thickness, which is surrounded by a layer of; (3) a short chain alkyl polymer, such as polypropylene, 32, of approximately one millimeter thickness. This construction of the upper layer 10 and chambers 15 through 18 provide significant improvement in containing the helium within the chambers such that a sufficient helium pressure is achieved over an acceptable and standard service life of the footwear.

Figure 4:
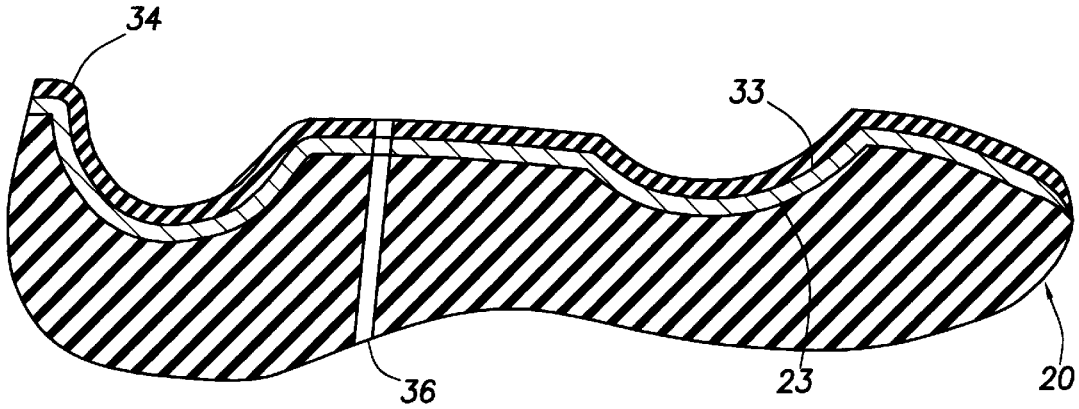
FIG. 4 is a cross-sectional view of the outsole of the sole of the present invention taken along the lengthwise axis of the sole.

Referring now to FIG. 4, the upper surface, 23, of outsole 20 is laminated with an approximately one millimeter layer of aluminum foil, 33. Over the layer of aluminum foil 33 is adhered a layer of a short chain alkene polymer, such as polyisobutylene, 34, of approximately one to two millimeters thickness. The layers of aluminum foil 33 and short chain alkene polymer 34 further improve the containment of helium during the service life of the footwear.

While the invention has been described herein by way of specific embodiments, it will be understood that the invention may be embodied in other forms.

I claim:

1. A footwear sole comprising:

an upper layer having a plurality of connecting chambers, said chambers filled with helium gas, said upper layer comprised of a material having a first layer of mylar, a second layer of aluminum foil, and a third layer of a short chain alkene polymer;

said upper layer having a substantially flat upper surface and a substantially flat bottom perimeter surface;

an outsole having a top and bottom surfaces and indentations on said top surface, said indentations corresponding in shape to said connecting chambers but sized slightly larger in height and width than said chambers, said upper perimeter portion of said outsole adhered or affixed to said substantially flat bottom perimeter surface of said upper layer; and a layer of a fluidic polymeric material interposed between said chambers of said upper layer and said indentations of said outsole.

* * * * *